US006884025B2

(12) United States Patent
Pickens et al.

(10) Patent No.: US 6,884,025 B2
(45) Date of Patent: Apr. 26, 2005

(54) SHIM LOCK/PIN ANTI-ROTATION BUMPER DESIGN

(75) Inventors: John T. Pickens, East Hartford, CT (US); Phillip Alexander, Colchester, CT (US); Anthony R. Bifulco, Ellington, CT (US); Kevin J. Cummings, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 156 days.

(21) Appl. No.: 10/261,471

(22) Filed: Sep. 30, 2002

(65) Prior Publication Data

US 2004/0062641 A1 Apr. 1, 2004

(51) Int. Cl.[7] ..... F01B 25/02
(52) U.S. Cl. ..... 415/160
(58) Field of Search ..... 415/160

(56) References Cited

U.S. PATENT DOCUMENTS 2,858,104 A * 10/1958 Kelk et al. ..... 415/190
4,812,106 A * 3/1989 Purgavie ..... 415/139
4,925,364 A * 5/1990 Das ..... 415/150
5,855,052 A * 1/1999 Becker et al. ..... 29/464

* cited by examiner

*Primary Examiner*—Ninh H. Nguyen
(74) *Attorney, Agent, or Firm*—Bachman & LaPointe, P.C.

(57) ABSTRACT

The present invention relates to a bumper system for use with a compressor variable vane system. The bumper system broadly comprises a synchronizing ring, a bumper, a shim for defining a gap between a bumper pad and the bumper, a pin for preventing rotation of the bumper relative to the synchronizing ring, and a device for fully trapping the shim. In a first embodiment, the device for fully trapping the shim comprises a sleeve passing through the synchronizing ring. In a second embodiment, the device for fully trapping the shim comprises a pin which passes through the synchronizing body. In a third embodiment, the device for fully trapping the shim comprises a fastener with a shoulder.

23 Claims, 4 Drawing Sheets

SHIM LOCK/PIN ANTI-ROTATION BUMPER DESIGN

STATEMENT OF GOVERNMENT INTEREST

The present invention was made under Contract No. F33657-91-C-007 with the United States Department of Air Force. The Government of the United States of America may have rights under this contract.

BACKGROUND OF THE INVENTION

The present invention relates to an improved shimable bumper system for use in a compressor variable vane system that fully traps the shim in case of lost screw preload and that has an anti-rotation feature.

The main components of a compressor variable vane system are the stator vanes, vane arms, synchronizing rings, bumpers, linkage system, and the actuator. The vane arms are used to control the incidence angle of the vanes in the compressor of gas turbine engines. The vanes are arranged as a stage set around the circumference of the compressor. The arm attaches to each vane spindle which rotates in a bearing mounted in the compressor case. The set of vanes are actuated by a circumferential synchronizing ring that rotates about the engine axis. The vane arm imparts motion from the synchronizing ring to the vane spindle. The linkage system and actuator imparts motion to the synchronizing ring. The bumper is used to control the concentricity and the deflection of the synchronizing ring throughout this motion by running at a pre-determined operating gap. Currently, thread adjustment and shimable adjustment are used to set this gap at assembly, taking into account the thermal resultant at operating temperature.

One current bumper configuration, shown in FIG. 1, uses thread adjustment to set the bumper gap. The configuration consists of a stud adjuster 10, a metallic bumper 12 with a bonded on composite liner, and a shear lock collar 14. The bumper 12 is anti-rotated via a matched milled feature 16 in the synchronizing ring 18. There are two technical issues with this configuration. The first is that the load path is through the threads which results in thread wear which leads to an increase in bumper gaps. The second issue is the bonding of a composite liner to a metallic bumper housing. Dis-bonding of the composite liner could occur due to loading and thermal cycling. The dis-bond of the liner also leads to an increase of bumper gaps. Increased bumper gaps decrease the synchronizing ring concentricity and increases the synchronizing ring distortion which leads to an increase in vane angle variation and loss in stall margin.

Thus, there is a need for a new bumper configuration.

SUMMARY OF THE INVENTION

Accordingly, it is an object of the present invention to provide an improved bumper system which avoids thread wear that leads to an increase in bumper gaps.

It is a further object of the present invention to provide an improved bumper system which avoids dis-bonding of a composite liner which can lead to an increase in bumper gaps.

It is still a further object of the present invention to provide an improved bumper system which can be retrofitted onto current gas turbine engine hardware.

The foregoing objects are attained by the bumper system of the present invention.

In accordance with the present invention, a bumper system for use with a compressor variable vane system broadly comprises a synchronizing ring, a bumper, a shim for defining a gap between a bumper pad and the bumper, means for fully trapping the shim, and means for preventing rotation of the bumper relative to the synchronizing ring.

Other details of the bumper system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
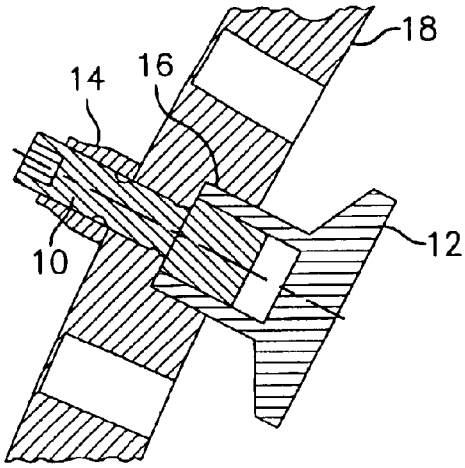
FIG. 1 (PRIOR ART)
FIG. 1 illustrates a prior art bumper system.
Figure 3:
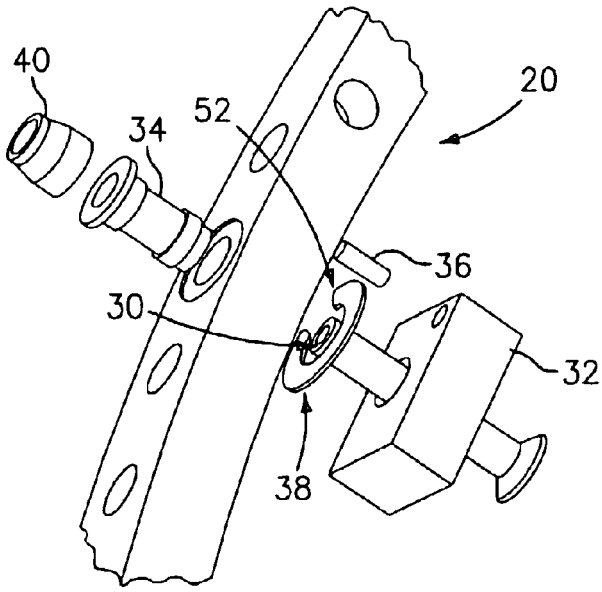
FIG. 3 is an exploded view of the bumper system of FIG. 2.
Figure 2:
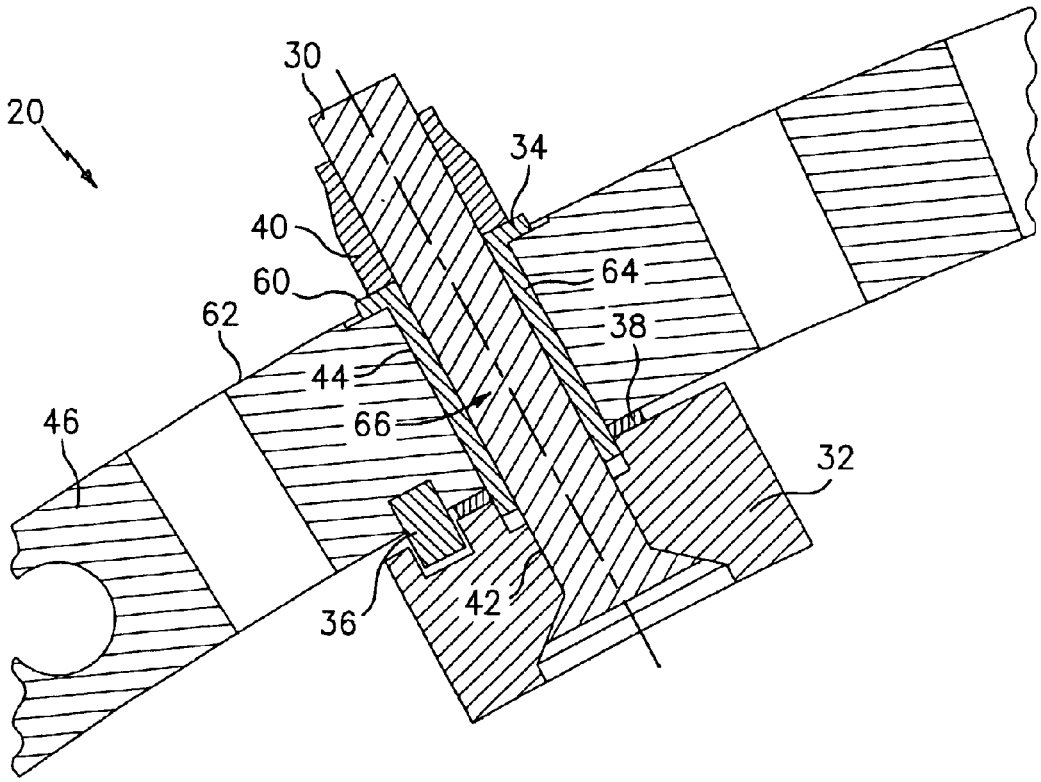
FIG. 2 illustrates a bumper system in accordance with the present invention.
Figure 4:
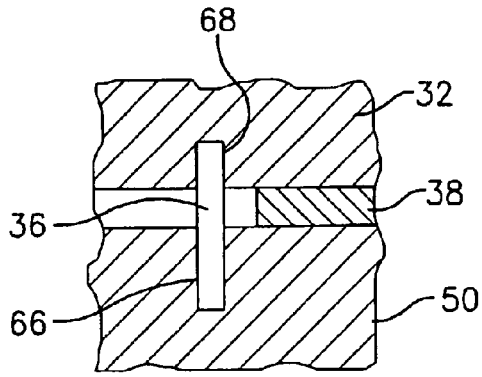
FIG. 4 is a sectional view showing the anti-rotation feature of the bumper system of FIG. 2.

Referring now to the drawings, FIGS. 2 through 4 illustrate a bumper system for use on a gas turbine engine in accordance with the present invention. The bumper system uses shims to set the bumper gaps. As shown in FIGS. 2 through 4, the bumper system 20 includes a fastener 30, such as a screw or a bolt having a thread at one end, a one-piece composite bumper 32, a shim-lock sleeve 34, a dowel pin 36, a shim 38, and a threaded shear lock collar 40 for engaging the threaded end of the fastener 30. The fastener 30 passes through a bore 42 in the bumper 32 and through a hole 44 in the synchronizing ring 46. As can be seen from FIG. 2, the hole 44 has a diameter greater than the diameter of the fastener 30.

A suitable composite material for the bumper 32 requires low coefficient of friction (lubricity) to minimize the frictional loading in the system. The material also needs to have dimensional stability and wear resistance to maintain running gaps to minimize the vane angle error. The temperature capability and material strength (compression, torsional, and fracture toughness) must be sufficient to meet assembly and operation conditions.

Figure 7:
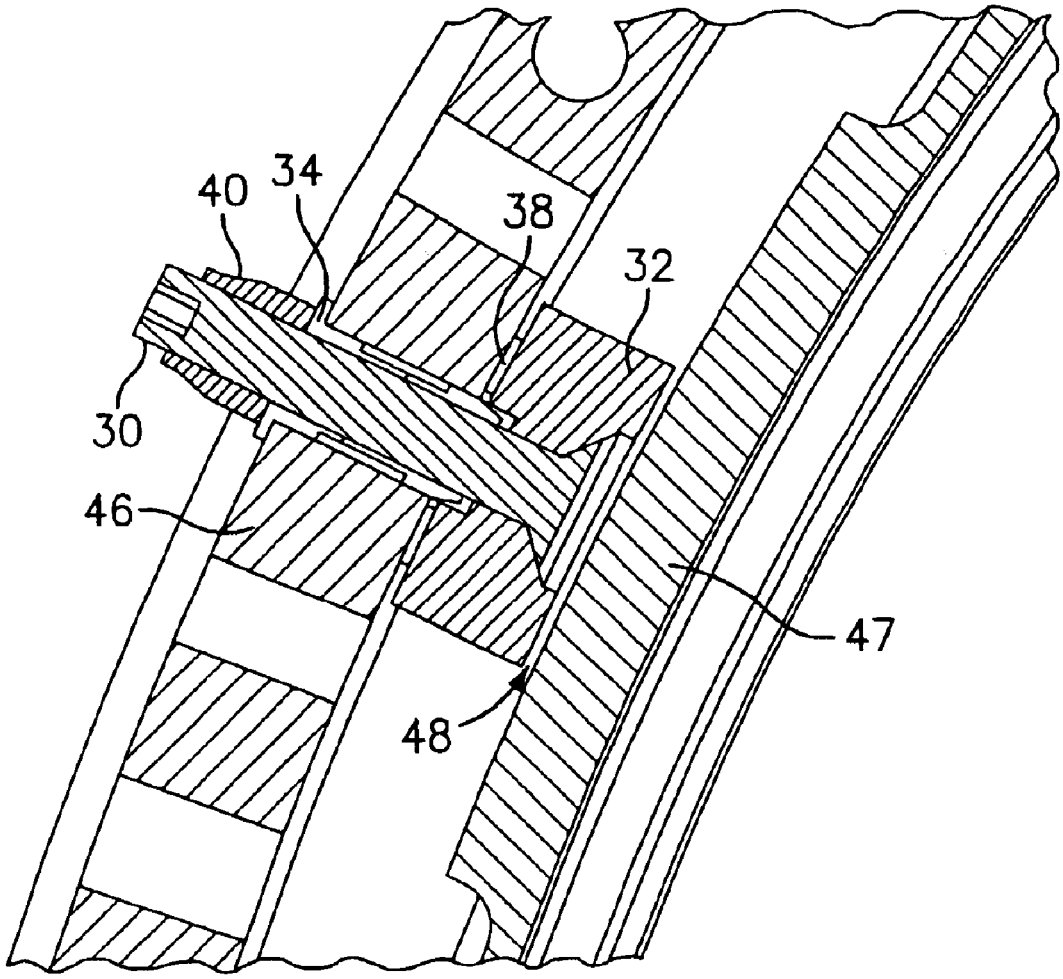
FIG. 7 is a sectional view showing a bumper spaced from a bumper pad.

As shown in FIG. 7, the shim 38 is used to set the gap 48 between the bumper 32 and a bumper pad 47 which is a machined feature on the high pressure compressor case. As shown in FIG. 3, the shim 38 has a slot 52 which allows the shim 38 to slide over the diameter of the fastener 30. Additionally, the shim 38 has an inner diameter greater than the diameter of the fastener 30.

The shim-lock sleeve 34 has a shoulder portion 60 which abuts the surface 62 of the synchronizing ring 46 and a cylindrical shaft portion 64 having an opening 66 through which the fastener 30 passes. The cylindrical shaft portion 64 has a length greater than the thickness of the synchronizing ring 46 so that the shaft portion 64 extends into the shim 38. The slot 52 has width which is less than the diameter of the cylindrical shaft portion 64. As a result, the shim 38 is fully trapped by the sleeve 34.

Referring now to FIG. 4, a dowel pin 36 fits into a hole 66 in the synchronizing ring 46 and a hole 68 in the bumper 32 and serves to prevent rotation of the bumper system. Because of the holes 66 and 68, the dowel pin 36 is fully trapped if there is a loss of screw pre-load.

After all of the elements have been positioned in the proper manner, the shear lock collar 40 is threaded onto the fastener 30 so that the shear lock collar 40 abuts the shoulder portion 60 of the shim lock sleeve 34.

One of the advantages to the bumper system of the present invention is that the primary load path is changed so that it goes through the synchronizing ring, not the threads, hence eliminating thread wear. The use of a one-piece composite bumper eliminates the dis-bond concern. Another advantage to the system of the present invention is that the shim remains fully trapped even if there is a loss of screw preload. Further, the shim is circular which allows symmetrical assembly and the shim lock sleeve is mistake proof during assembly. Other advantages include cost and weight reductions with respect to current systems and production benefits.

While the bumper system of FIGS. 2 through 4 has been illustrated as having one shim, more than one shim could be used if desired.

Figure 5:
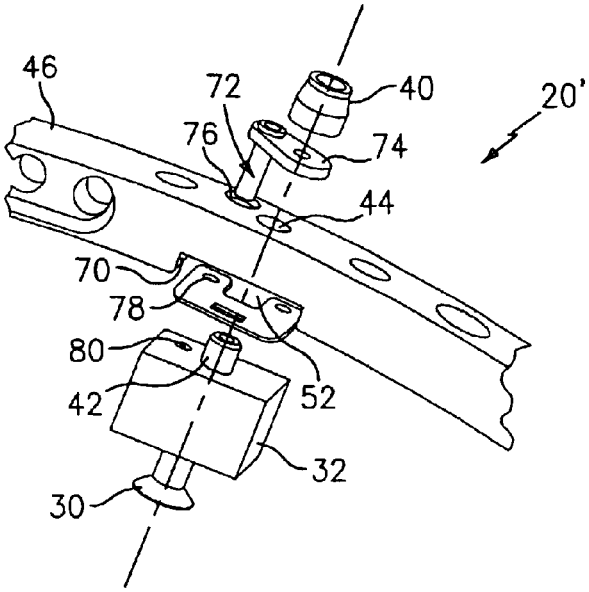
FIG. 5 is an exploded view of an alternative embodiment of a bumper system in accordance with the present invention.

Referring now to FIG. 5, an alternative bumper system 20' is illustrated. In this system, the synchronizing ring 46 is provided with a groove 70 and a hole 76. The shim 38 fits within the groove 70. As before, a fastener 30 and a lock collar 40 are used to mount a one-piece composite bumper 32 to the synchronizing ring 46. The fastener 30 passes through a bore 42 in the bumper 32, through the slot 52 in the shim 38, and then through the hole 44 in the synchronizing ring 46. As before, the shim 38 is used to provide a gap between the bumper 32 and a bumper pad 47. Also, the alternative bumper system 20' could use more than one shim 38.

To prevent rotation of the bumper 32 during use and to trap the shim 38, a pin 72 with a washer 74 is provided. The pin 72 is inserted into a through bore 76 in the synchronizing ring, into a mating engagement bore 78 in the shim 38 and then into a receiving bore 80 in the bumper 32. The pin 72 may be threaded at its end to engage and mate with a thread in the bore 80. When the pin 72 is engaged with the bumper 32, the washer 74 abuts against a surface of the synchronizing ring 46.

Figure 6:
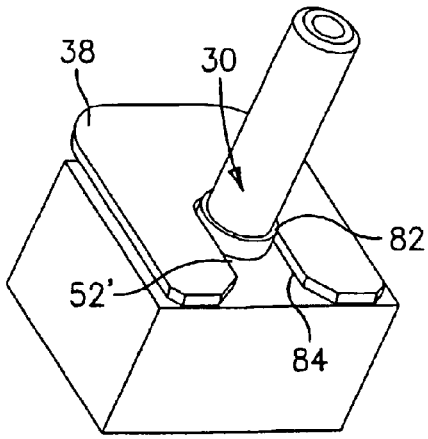
FIG. 6 is a schematic representation of an alternative technique for trapping a shim used in the bumper systems of the present invention.

FIG. 6 illustrates an alternative technique for trapping the shims 38 used in the bumper systems 20 and 20'. In this technique, the fastener 30 is provided with a shoulder 82. After the fastener 30 has been inserted into the bumper 32 so that it extends out the bumper, the shim 38 and a substantially U-shaped slot 52' are positioned over the fastener 30 so that the slot side walls 84 of the shim engage and abut the shoulder 82. To fully trap the shim 38, the dimension between the side walls 84 should be less than the diameter of the fastener 30 in the region of the shoulder 82.

It is apparent that there has been provided in accordance with the present invention a shim lock/pin anti-rotation bumper design which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A bumper system for use with a compressor variable vane system, said bumper system comprising:

a synchronizing ring;

a bumper joined to said synchronizing ring;

a shim for defining a gap between a bumper pad and said bumper; and means for fully trapping the shim.

2. A bumper system according to claim 1, further comprising:

means for preventing rotation of said bumper relative to said synchronizing ring.

3. A bumper system according to claim 1, wherein said bumper is a one-piece composite bumper.

4. A bumper system for use with a compressor variable vane system, said bumper system comprising:

a synchronizing ring;

a bumper joined to said synchronizing ring;

a shim for defining a gap between a bumper pad and said bumper;

means for fully trapping the shim;

said shim having a slot with a width; and said means for fully trapping the shim comprising a shim-lockable sleeve having a diameter greater than the width of said slot.

5. A bumper system according to claim 4, further comprising:

said synchronizing ring having an aperture extending therethrough; and said sleeve having a cylindrical portion which passes through said aperture.

6. A bumper system according to claim 5, further comprising:

said sleeve having a shoulder portion which abuts a surface of said synchronizing ring.

7. A bumper system according to claim 5, further comprising:

said cylindrical portion of said sleeve being hollow;

said bumper having a bore;

a fastener passing through said bore in said bumper and said hollow cylindrical portion; and a collar for engaging and locking said fastener.

8. A bumper system for use with a compressor variable vane system, said bumper system comprising:

a synchronizing ring;

a bumper joined to said synchronizing ring;

a shim for defining a gap between a bumper pad and said bumper;

means for fully trapping the shim;

means for preventing rotation of said bumper relative to said synchronizing ring; and said rotation preventing means comprising a first hole in said synchronizing ring, a second hole in said bumper, and a dowel pin fitting in said first and second holes.

9. A bumper system for use with a compressor variable vane system, said bumper system comprising:

a synchronizing ring;

a bumper joined to said synchronizing ring;

a shim for defining a gap between a bumper pad and said bumper;

means for fully trapping the shim;

said synchronizing ring having a through bore, said shim having an engagement bore, said bumper having a receiving bore, and said means for fully trapping the shim comprising a pin which passes through said through bore and said engagement bore and is received in said receiving bore.

10. A bumper system according to claim 9, wherein said pin has a washer attached thereto an said washer abuts a surface of said synchronizing ring.

11. A bumper system according to claim 9, wherein said pin also acts as said means for preventing rotation of said bumper relative to said synchronizing ring.

12. A bumper system for use with a compressor variable vane system, said bumper system comprising:

a synchronizing ring;

a bumper joined to said synchronizing ring;

a shim for defining a gap between a bumper pad and said bumper;

means for fully trapping the shim;

said shim having a slot with side walls and said means for fully trapping the shim comprising a fastener having a shoulder for engaging said slot side walls.

13. A bumper system according to claim 12, wherein said fastener has a diameter and said side walls are spaced apart by a dimension less than said diameter.

14. A bumper system according to claim 12, wherein said slot is substantially U-shaped.

15. A bumper system according to claim 12, wherein said fastener passes through a hole in said bumper and secures said bumper to said synchronizing ring.

16. A bumper system for use with a compressor variable vane system, said bumper system comprising:

a synchronizing ring;

a bumper joined to said synchronizing ring;

means for preventing rotation of said bumper relative to said synchronizing ring; and said rotation preventing means comprising a first hole in said synchronizing ring, a second hole in said bumper, and a dowel pin inserted into said first and second holes.

17. A bumper system according to claim 16, further comprising at least one shim for defining a gap between a bumper pad and said bumper.

18. A bumper system according to claim 16, wherein said bumper is a one-piece composite bumper.

19. A bumper system for use with a compressor variable vane system, said bumper system comprising:

a one-piece composite bumper;

at least one shim for defining a gap between a bumper pad and said bumper; and means for fully trapping the at least one shim.

20. A bumper system according to claim 19, further comprising:

a synchronizing ring;

said bumper being joined to said synchronizing ring; and means for preventing rotation of said bumper relative to said synchronizing ring.

21. A bumper system according to claim 19, wherein said trapping means comprises a pin which passes through a first bore in said at least one shim and is received in a second bore in said bumper.

22. A bumper system for use with a compressor variable vane system, said bumper system comprising:

a one-piece composite bumper;

at least one shim for defining a gap between a bumper pad and said bumper;

means for fully trapping the at least one shim; and said trapping means comprising a shim-lockable sleeve, a fastener passing through said bumper and said sleeve, and a collar for engaging and locking said fastener.

23. A bumper system for use with a compressor variable vane system, said bumper system comprising:

a one-piece composite bumper;

at least one shim for defining a gap between a bumper pad and said bumper;

means for fully trapping the at least one shim; and each said shim having a slot with side walls and said trapping means comprising a fastener having a shoulder for engaging said side walls.

* * * * *

UNITED STATES PATENT AND TRADEMARK OFFICE

CERTIFICATE OF CORRECTION

PATENT NO. : 6,884,025 B2
DATED : April 26, 2005
INVENTOR(S) : Pickens et al.

It is certified that error appears in the above-identified patent and that said Letters Patent is hereby corrected as shown below:

Column 1,
Line 6, "F33657-91-C-007" should read -- F33657-91-C-0007 --.

Column 5,
Line 6, "an" should read -- and --.

Signed and Sealed this

Fifteenth Day of November, 2005

JON W. DUDAS
*Director of the United States Patent and Trademark Office*